US006475288B1

(12) United States Patent
Oliver

(10) Patent No.: US 6,475,288 B1
(45) Date of Patent: Nov. 5, 2002

(54) SMOKE-MODIFYING AGENTS AND SMOKING MATERIAL RODS COMPRISING SMOKE-MODIFYING AGENTS

(75) Inventor: Richard Oliver, Southampton (GB)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 09/762,738

(22) PCT Filed: Aug. 6, 1999

(86) PCT No.: PCT/GB99/02602

§ 371 (c)(1),
(2), (4) Date: Feb. 12, 2001

(87) PCT Pub. No.: WO00/08958

PCT Pub. Date: Feb. 24, 2000

(30) Foreign Application Priority Data

Aug. 14, 1998 (GB) ..... 9817605

(51) Int. Cl.[7] ..... A24B 15/00

(52) U.S. Cl. ..... 131/274; 131/335; 131/352; 264/171; 264/183; 428/373; 428/375

(58) Field of Search ..... 131/274, 335, 131/352; 264/171, 183; 428/373, 375

(56) References Cited

U.S. PATENT DOCUMENTS 5,144,966 A 9/1992 Washington

FOREIGN PATENT DOCUMENTS

| | | |
|---|---|---|
| EP | 0 040 048 A | 11/1981 |
| EP | 0 464 324 A | 1/1992 |
| GB | 2 070 409 A | 9/1981 |
| WO | WO98 15191 A | 4/1998 |

*Primary Examiner*—Steven P. Griffin
*Assistant Examiner*—Mark Halpern
(74) *Attorney, Agent, or Firm*—John F. Salazar; Charles G. Lamb; Middleton Reutlinger

(57) ABSTRACT

A process for the manufacture of a homogeneous fibriform element comprising a smoke-modifying agent. In the process a mixture comprising a solution of a polysaccharide (an alginate for example) and a smoke-modifying agent (menthol for example) is fed through a nozzle and a jet of the mixture issuing from the nozzle is brought into contact with a solution containing multivalent cations (such as calcium ions). Solidification of the mixture is thus effected. In a second aspect of the invention, a fibriform element is manufactured by passing a thread through a mixture comprising a solution of a polysaccharide and a smoke-modifying agent whereby the thread is coated with the mixture. The coated thread is brought into contact with a solution containing multivalent cations thus to effect solidification of the mixture on the thread. A fibriform element as manufactured by the inventive process and a smoking article comprising such a fibriform element are also provided for.

17 Claims, 3 Drawing Sheets

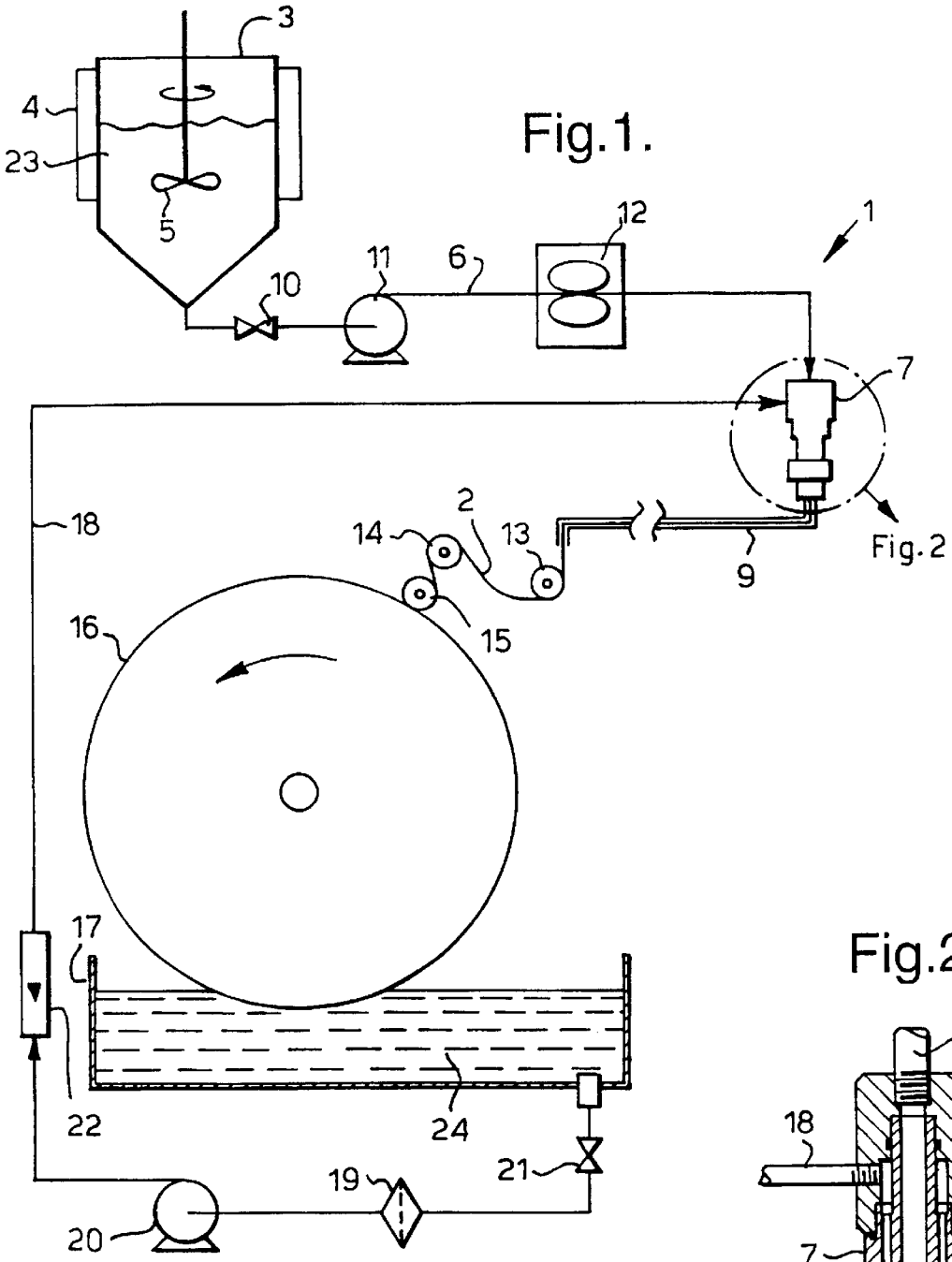
Fig.1.
3
4
23
5
10
11
6
12
1
7
18
2
14
13
9
Fig.2
16
15
17
22
24
21
19
20
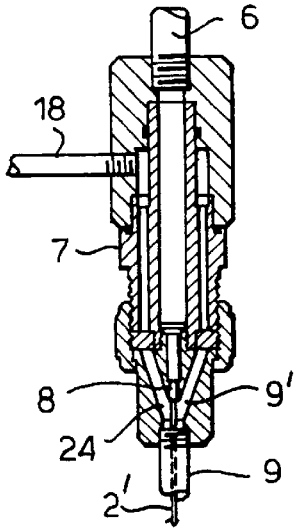
Fig.2.
6
18
7
8
9'
24
9
2'

SMOKE-MODIFYING AGENTS AND SMOKING MATERIAL RODS COMPRISING SMOKE-MODIFYING AGENTS

"This application claims priority to a PCT International Application PCT/GB99/02602, filed Aug. 6, 1999, International Application published on Feb. 2, 2000 as WO 00/08958, which claims priority to UK Patent Application 9817605.0, filed Aug. 14, 1998."

BACKGROUND

The present invention relates to the manufacture of fibriform material comprising a smoke-modifying agent.

GB 2 070 409 discloses a filament comprising smoking-modifying agents. The filament may be formed of or obtained from a fibrous material, such as tobacco, paper, cotton or man-made textile fibres, which material readily carries or can be readily impregnated with smoke-modifying agents. A possible disadvantage of the invention the subject GB 2 070 409 is that the smoke-modifying agents, if volatile, as is menthol for instance, can readily migrate from the filament, resulting in losses of the agent(s). The migration of significant amounts of the smoke-modifying agents from the region of application is highly undesirable and thus for example methods of encapsulation of flavourants have been devised to prevent such migration. Considerable work has been undertaken in respect of the encapsulation of flavourants in beads or microcapsules. However, problems may exist in maintaining such beads or microcapsules in cigarette tobacco rods.

U.S. Pat. No. 5,144,966 discloses a flavourant-release additive in the form of a filament for incorporation in the combustible filler of cigarette products and a method of production of such a filament. The filament disclosed in U.S. Pat. No. 5,144,966 comprises a core matrix and a co-extensive sheath coating, wherein the core matrix comprises a mixture of flavourant compound and a polysaccharide binder, and the sheath coating comprises a non-porous calcium alginate film. Such filaments are produced by a process which comprises 1) extruding an aqueous mixture of flavourant compound and a polysaccharide binder through an inner nozzle to form a gelled core fibre, 2) simultaneously co-extruding an aqueous solution of water-soluble alginate salt through an outer nozzle, coaxial of the inner nozzle, to apply a co-extensive sheath coating on the core fibre, and 3) contacting the thus formed filament with an aqueous calcium compound solution to convert sodium alginate to insoluble calcium alginate in the filament sheath coating, thus to encapsulate the flavourant. This co-extrusion method for forming a type of encapsulated filament is cumbersome when producing large quantities of filaments, which of course would be required if such filaments were to be incorporated into cigarettes at commercial manufacturing speeds.

It is an object of the present invention to provide an improved and commercially practical process for the manufacture of a fibriform material comprising a smoke-modifying agent(s).

SUMMARY OF THE PREFERRED EMBODIMENT

The present invention provides a process for the manufacture of a homogeneous fibriform element comprising a smoke-modifying agent, wherein a mixture comprising a solution of a polysaccharide and a smoke-modifying agent is fed through nozzle means, and a jet of said mixture issuing from said nozzle means is brought into contact with a solution containing multivalent cations thus to effect solidification of said mixture.

The element manufactured by the inventive process is homogeneous in the sense that the polysaccharide and the smoke-modifying agent form together a matrix of constant constitution throughout the element and the term "homogeneous" is to be interpreted accordingly.

As will be appreciated by those skilled in the art, the process of solidification, i.e. the production of the aforesaid matrix, proceeds by way of a chemical reaction between cations of the solution containing multivalent cations and cations of the polysaccharide.

The non-solid mixture may take the form of, for example, a solution, a dispersion or an emulsion.

Advantageously, the mixture is heated to provide an elevated temperature of the mixture of, for example, 45° C. and is fed at an elevated temperature through the nozzle means. Suitably, whilst at an elevated temperature, the mixture is stirred continuously.

Preferably, the jet of the mixture issuing from the nozzle means is fed into a body of the solution containing multivalent cations. More preferably the jet of the mixture issuing from the nozzle means is fed into a stream of the solution. In the latter case, the stream of the solution containing multivalent cations suitably flows in a direction substantially parallel to the direction in which the mixture is fed through and issues from the nozzle means. Advantageously, the stream of the solution containing multivalent cations flows within conduit means. When conduit means are present the nozzle means and conduit means may suitably form an integral unit. Suitably, the mixture issuing from the nozzle means is carried by the solution containing multivalent cations through a portion, at least, of the conduit means. The length of the conduit means through which the mixture is carried is preferably of a length such that solidification of the mixture is complete or substantially complete upon issuance of the mixture from said conduit means at the downstream end thereof. As a person skilled in the art will readily appreciate, the flow rate of the mixture issuing from the nozzle means will affect the residency time of the mixture within the conduit means. It is conceivable too that this residency time may be affected by the flow rate of the cation containing solution.

Alternatively, the solution containing multivalent cations may be sprayed onto the jet of the mixture issuing from the nozzle means.

Suitably, the mixture is forced to and through the nozzle means under the action of a positive displacement pump, for example a progressing cavity pump as manufactured by Robbins and Myers under Model No. B4015. Alternatively, the mixture may be forced to and through the nozzle means under the action of pressurised air. Much by preference the mixture should exit the nozzle means at a substantially constant flow rate. The mixture may be continuously agitated in storage means before being fed to the nozzle means According to a second aspect thereof, the present invention provides a process for the manufacture of a fibriform element comprising a smoke-modifying agent, wherein a thread is passed through a mixture comprising a solution of a polysaccharide and a smoke-modifying agent whereby said thread is coated with said mixture, the coated thread being brought into contact with a solution containing multivalent cations thus to effect solidification of said mixture on said thread.

Advantageously, the thread is comprised of a fibrous material, for example, tobacco, paper, cotton or a man-made textile.

As will be readily apparent to those skilled in the art, a fibriform element the product of a process according to the second aspect of the present invention is of homogeneous constitution in the sense of the above definition of "homogeneous", excepting, of course, for the presence in the element of the thread.

In carrying out the process according to either of the above defined aspects of the present invention, as an alternative or in addition to bringing the mixture comprising a solution of a polysaccharide and a smoke-modifying agent into contact with a solution containing multivalent cations, the mixture can be brought into contact with an acidic solution, acetic acid for instance, thus to effect solidification of said mixture.

Suitably, the so-formed solidified fibriform element (formed according to either aspect of the invention) is wound onto a rotating drum. Preferably, the drum, at least at the peripheral region thereof, is comprised of plastics material. Preferably, the fibriform element is wound onto the drum, at least initially, in a single layer. A traverse unit may be used to pitch the fibriform element across the drum as the element is wound onto the drum. If it is deemed necessary, the drum, or a lowermost portion thereof, may be positioned in a bath containing the cation solution, so that as the drum, with the element wound thereupon, rotates, a lowermost portion of each turn of the element is immersed in the cation solution.

Following solidification of the fibriform element, the element may be washed, in for example water.

If there is a requirement to dry the so-formed fibriform element, various methods are available to persons skilled in the art for drying the element. For example, the element wound on the drum may be placed, along with the drum, in an oven at a pre-set temperature for a pre-determined period of time or alternatively air drying means may be used to dry the element on the drum. As another alternative, the element, before being wound onto the drum, may be passed through an annular air knife or a drying tunnel, or multiple combinations thereof. As a person skilled in the art would readily appreciate, combinations of these various methods may also be used.

Conveniently, the fibriform element in a dry, non-adhesive condition, is removed from the above mentioned drum and wound onto a lesser diameter spool for storage, the spool being of an appropriate diameter such that excessive bending of the element is avoided. Alternatively, the element can be cut into lengths, of about 30 cm for example, and stored for subsequent use. According to another alternative, the solidified fibriform element may be stored on the rotatable drum.

Elements manufactured by use of the present invention are preferably not breakable merely by being bent or drawn on longitudinally. Thus, if deemed necessary, plasticisers, glycerol and/or propylene glycol for instance, can be added to the initial mixture in order to increase the flexibility and/or tensile strength of the elements.

The initial mixture may further comprise an emulsifier if such an emulsifier is considered to be a requirement. The emulsifier may be, for example, a modified polysaccharide such as modified starch.

The homogeneous element is such that at least one smoke-modifying agent is encapsulated, in the sense of being held in the element against escape therefrom by, for example, volatilisation at ambient temperatures.

The polysaccharide solution is preferably an aqueous solution. The polysaccharide may suitably be an acid polysaccharide in the form of an alkali metal salt, for example an alginate, particularly sodium alginate. Other suitable polysaccharides which may be contemplated include pectins, gellan gum, carrageenan, agar, gum arabic, xanthan gum and guar gum.

The solution containing multivalent cations may be for example, an aqueous or alcoholic solution. The multivalent cations are ions of the group consisting of calcium, strontium, barium, iron, silver, aluminium, manganese, vanadium, copper and zinc, particularly calcium ions. For instance, a suitable aqueous solution containing multivalent cations is aqueous calcium chloride.

The present invention further provides a fibriform element as manufactured by a process in accordance with the present of invention.

Much by preference, the fibriform element is of a constant cross-sectional shape and size along the length thereof. Suitably, the element is of circular cross-section, in which case the diameter thereof will generally not be more than about 3 mm, preferably not exceeding about 1 mm.

The present invention further provides a smoking article comprising a smoking material rod, within which rod there extends, generally longitudinally of the rod, a fibriform element as manufactured by a process in accordance with the present invention.

Preferably, the fibriform element extends co-extensively of the smoking material rod. More than one fibriform element may extend, within the smoking rod, generally longitudinally thereof, in which case, preferably each of the elements extends within an axial zone of the rod. Advantageously, if a single only element extends within the smoking material rod, the element extends at least substantially coaxially of the rod. An advantage existing as a consequence of the element(s) extending within an axial zone of the smoking material rod is that when a smoking article comprising the smoking material rod is smoked, losses of smoke-modifying agent to sidestream smoke are minimised and thus the transfer efficiency of the smoke-modifying agent to the mainstream smoke is improved.

Suitable smoke-modifying agents may comprise, for example, tobacco dust or flavourant(s), menthol and/or furaneol, for example. In the former case, the tobacco dust may be impregnated with a flavourant.

BRIEF DESCRIPTION OF THE FIGURES

In order that the present invention may be clearly understood and readily carried into effect, reference will now be made, by way of example, to the accompanying diagrammatic drawings, in which:

FIG, 1 shows apparatus for the manufacture of a fibriform element;

FIG. 2 shows an enlarged longitudinal section of an integral nozzle and conduit unit of the apparatus shown in FIG. 1;

Reference numbers in respect of common features have been maintained constant in all of the Figures. In FIG. 1, apparatus for the manufacture of a fibriform element 2 is generally depicted by reference numeral 1. A vessel 3 comprises a surrounding heating jacket 4 and stirring means 5. The vessel 3 is inter-connected by means of a delivery tube 6 to a nozzle and conduit unit 7, which unit 7 comprises a nozzle 8 and a conduit means 9, comprising an upstream portion 9', as an integral unit. The upstream portion 9' of the conduit means 9 extends about the conically shaped nozzle 8. As is shown in FIG. 2, the conduit means 9 extends downstream from the vicinity of the nozzle 8. Valve means 10, a pump 11 and a flowmeter 12 are situated in the delivery tube 6. Idler rollers 13, 14 and 15 mounted on a traverse unit (not shown) are positioned at an outlet location of the conduit means 9. The apparatus 1 further comprises a rotatable drum 16, the direction of rotation of which is indicated by an arrow. A fluid bath 17 is situated beneath the drum 16 and also beneath the outlet location of the conduit means 9. The fluid bath 17 is connected via a delivery tube 18 to the nozzle means 8 of the nozzle and conduit unit 7. Sieving means 19, a pump 20, valve means 21 and a flowmeter 22 are situated in the delivery tube 18.

Figure 3:
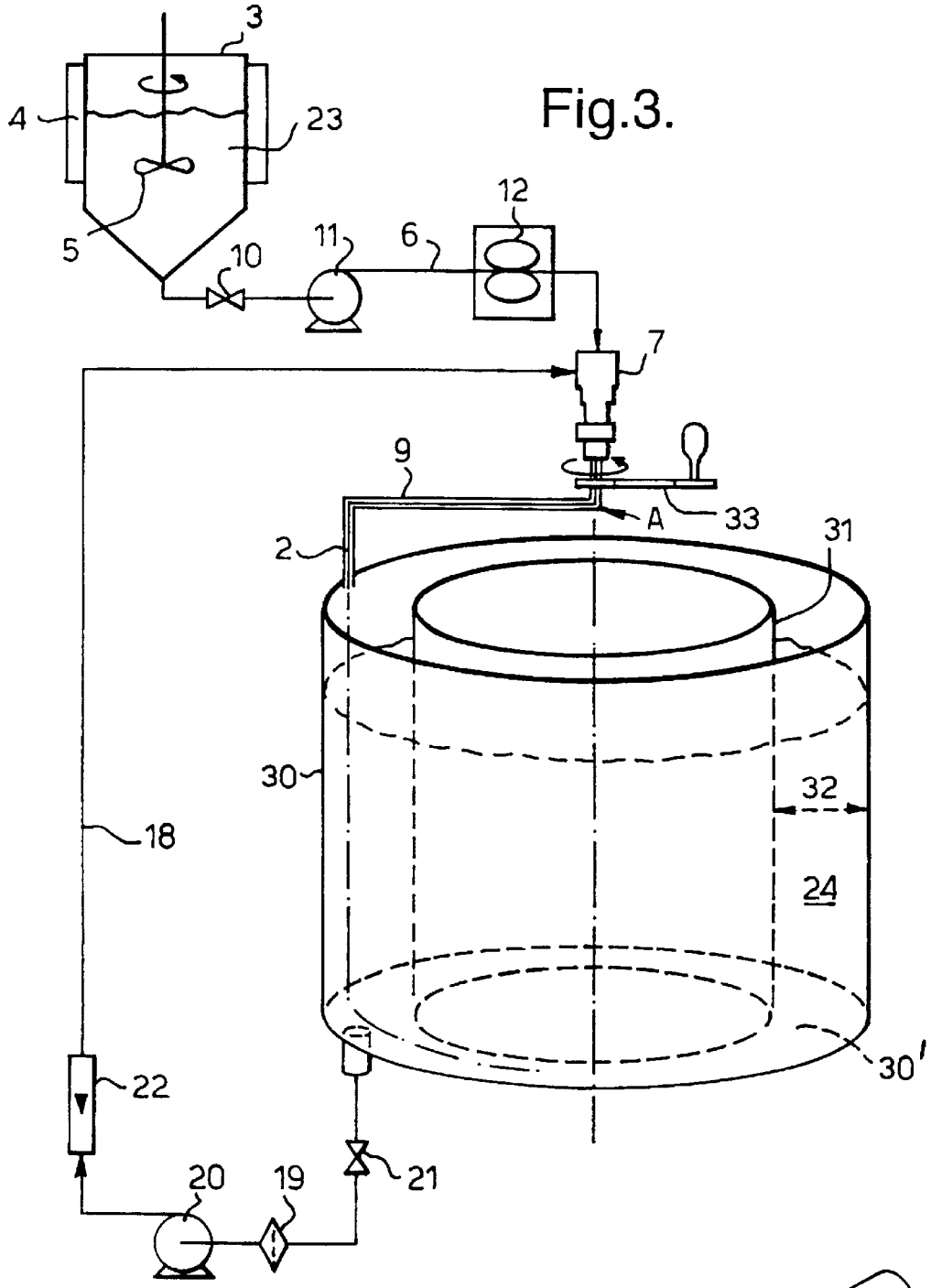
FIG. 3 shows apparatus alternative to that of FIGS. 1 and 2.

In use of the apparatus 1 an emulsion 23, of an aqueous sodium alginate solution and a menthol and propylene glycol solution (80% menthol:20% propylene glycol), the ratio of menthol to alginate in the emulsion being 1:1, is maintained at an elevated temperature of about 45° C. in the vessel 3 by means of the heating jacket 4.

The emulsion 23 in the vessel 3 is continuously agitated by the stirring means 5, which stirring means 5 takes the form of a rotary impeller. The emulsion 23 is transferred to the nozzle and conduit unit 7, via the delivery tube 6, under the action of the pump 11. The pump 11 is a progressing cavity pump manufactured by Robbins and Myers under Model No. B4015. The flow rate of the emulsion 23 through the delivery tube 6 is indicated by the flowmeter 12 and adjusted by alteration of the rotary speed of the pump 11. The emulsion 23 is supplied to the nozzle and conduit unit 7 in a continuous manner. As can be appreciated from FIG. 2, in the course of its passage from the tube 6 to and through the nozzle and conduit unit 7, the emulsion 23 passes through the centrally arranged nozzle 8. Thus a jet 2' of the emulsion 23 continuously issues from the exit orifice of the nozzle 8. The jet 2' of emulsion 23 issuing from the nozzle 8 is brought into contact with an aqueous solution of calcium chloride 24 (4–6% by weight). The aqueous solution is delivered via the tube 18 and then flows through the conduit means 9 and around and thus into contact with the jet 2'. The flow of the aqueous solution 24 aids the propulsion of the jet 2' through the conduit means 9.

The residency time of the emulsion 23 and the surrounding calcium chloride solution 24 in the conduit means 9 is such that the emulsion 23 has undergone a large measure of solidification such that upon exiting the conduit means 9 as fibriform element 2 such that the element 2 is self-sustaining.

A suitable residency time of the emulsion 23 and the surrounding calcium chloride solution 24 in the conduit means 9 may be 2.4 seconds when the following parameters are met: the nozzle 8 is of an exit orifice diameter of 2 mm, the conduit 9 is of a bore diameter of 4 mm, the drum 16 rotates at a surface speed of 37 m/minute, the emulsion 23 flow rate is about 94 ml/minute, the flow rate of the aqueous solution 24 is about 280 ml/minute and the length of the conduit is 1.5 m.

Upon exiting the conduit means 9 the fibriform element 2 is fed about the idler rollers 13, 14, 15, which idler rollers 13, 14, 15, as above mentioned, are mounted on a traverse unit (not shown) and function to maintain the fibriform element 2 at a suitable tension and to position the fibriform element 2 on the rotating drum 16. That is to say the idler rollers 13, 14, 15 and the traverse unit pitch the fibriform element 2 across the rotating drum 16 as the element 2 is wound onto the drum 16. The drum 16 is preferably a smooth, plastic drum with a diameter of about 700 cm, at least. The fluid bath 17 is positioned such that a lower portion of the rotating drum 16 is immersed in the aqueous solution of calcium chloride 24 in the fluid bath 17.

The aqueous solution 24 is supplied to the nozzle and conduit unit 7 from the fluid bath 17 via delivery tube 18 under the action of the pump 20. The aqueous solution 24 passes through valve means 21, the sieving means 19 and the flowmeter 22. Aqueous solution 24 exiting conduit 9 is returned, by gravity, to fluid bath 17.

When the total length of the fibriform element 2 wound onto the drum 16 reaches the maximum capacity of the drum 16, pumps 11 and 20 are stopped, whereby the fibriform element production process is suspended. Rotation of the drum 16 is maintained until the end point of the solidification process of the element 2 has been reached. The calcium chloride solution 24 in the bath 17 is then exchanged for water, thus to wash the element 2 as the drum 16 rotates. The drum 16 with the element 2 wound thereon may then be transferred to an oven set to provide a temperature of about 40–50° C. in order to dry the element 2.

Subsequently, the fibriform element 2 may be transferred to a storage spool (not shown). The transfer of the element 2 from the drum 16 to a smaller storage spool is conducted by rotating the drum 16 at a fixed speed as a jockey arm controls the speed of the slave storage spool. A traverse arm pitches the thread on the storage spool.

Figure 6:
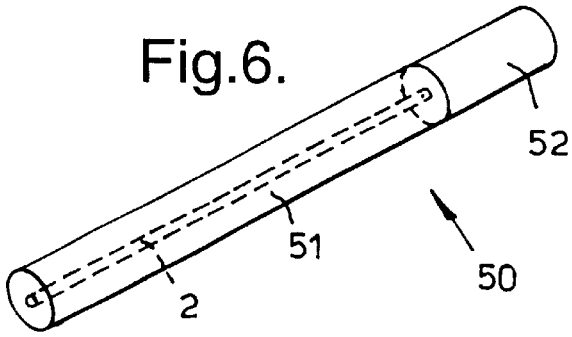
FIG. 6 shows a smoking article, viz. a cigarette, incorporating a fibriform element.

Storage spools, each with a fibriform element 2 wound thereon, are mounted directly on feed means operable to continuously feed the element to an upper location of the chimney of a conventional cigarette making machine for the manufacture thereof of a smoking article comprising a fibriform element (see FIG. 6).

FIG. 3 depicts a further apparatus for the manufacture of a fibriform element 2. The apparatus resembles that depicted in FIG. 1, excepting that the fibriform element 2 exiting the conduit 9 is fed into a drum 30 rather than onto a rotative drum 16. The drum 30 comprises a solid central cylindrical core 31 thus to form a hollow annulus 32 between the peripheral wall of the drum 30 and the peripheral wall of the core 31. The annulus 32 is closed at the lower end thereof by a wall 30', but is open at the upper end thereof. The annulus 32 contains an aqueous solution of calcium chloride 24.

The conduit 9 comprising a hinge mechanism (depicted as A in FIG. 3) is rotated by rotation means 33, such that the exit orifice of the conduit 9 is rotated around the annulus 32 and the fibriform element 2 exiting the conduit 9 is wound into the annulus 32 such as to be immersed in the solution therein.

A pump 20 and associated equipment, as that described in respect of the fluid bath 17 in FIG. 1, is present to deliver aqueous solution 24 from the annulus 32 to the nozzle and conduit unit 7. As mentioned above in respect of the FIG. 1 apparatus, the element 2 is washed by replacing the calcium chloride solution 24 with water. The element 2 can then be dried and either fed directly to a cigarette making machine (not shown) or onto a storage spool (not shown).

Figure 5:
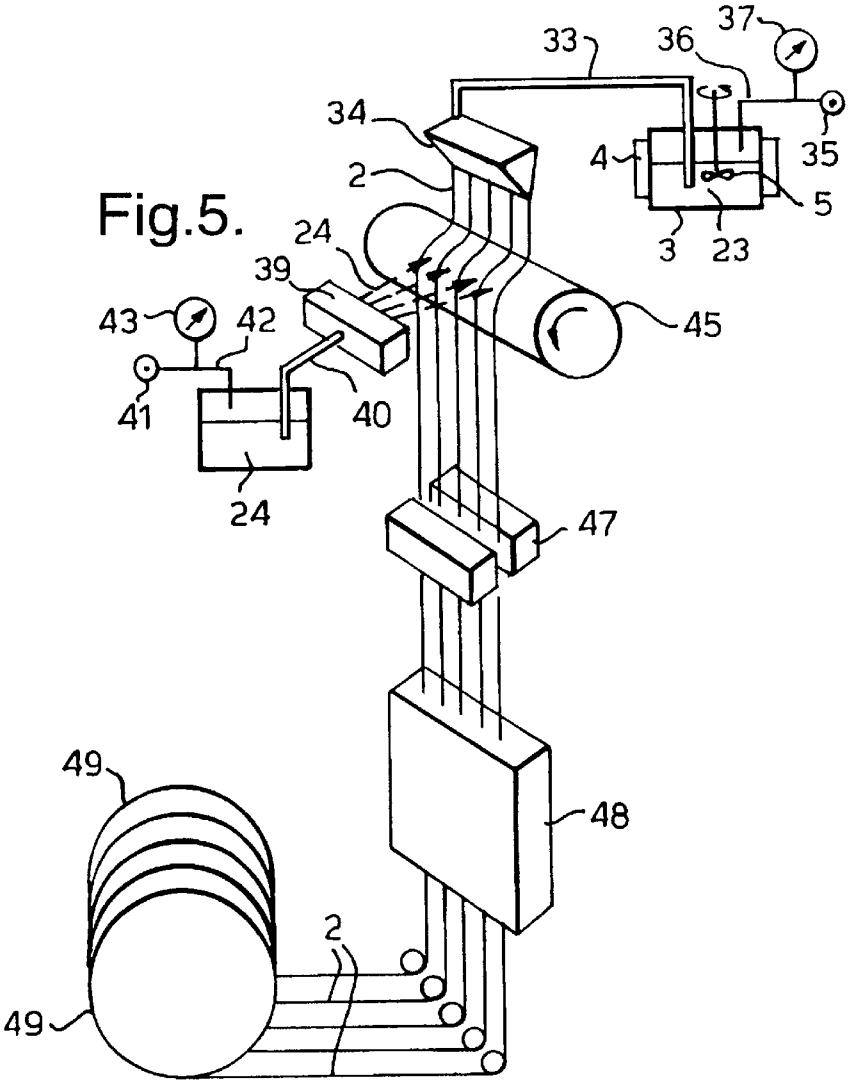
FIG. 5 shows yet further apparatus operable for the continuous manufacture of a plurality of fibriform elements.
Figure 4:
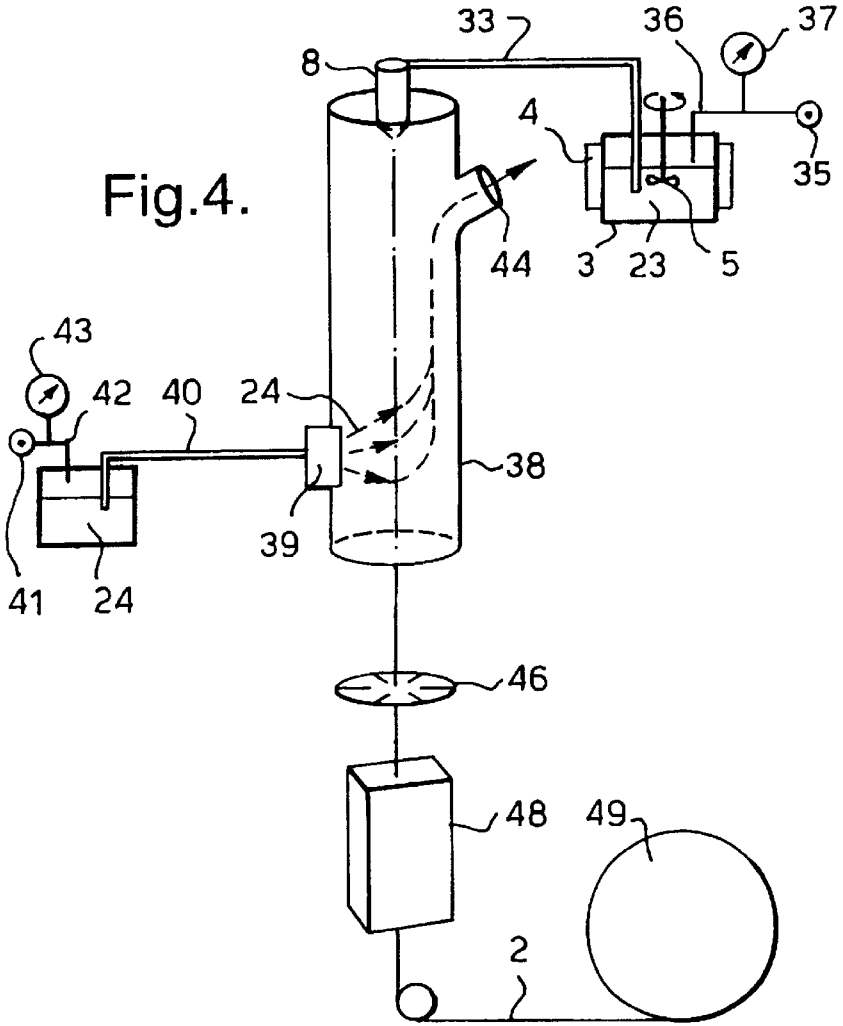
FIG. 4 shows further apparatus, which further apparatus is operable for the continuous manufacture of a fibriform element.

FIGS. 4 and 5 depict generally first and second apparatus for the continuous manufacture respectively of a single fibriform element 2 and a plurality of fibriform elements 2, in which manufacture the emulsion 23 and the solution 24 are brought into contact by means of spraying the solution 24 onto a jet of the emulsion 23. In use of these apparatus a continuously heated and stirred aqueous emulsion 23, of the same constitution as that hereinabove detailed in respect of the operation of the FIG. 1 apparatus, is transferred from heated vessel 3 via a delivery tube 33 to either a single nozzle head 8 (as depicted in FIG. 4) or to a multiple nozzle head 34 (as depicted in FIG. 5). Pressurised air is used for this transfer, the pressurised air being supplied from an air source 35 via an air line 36. A pressure gauge 37 is positioned in the air line 36. The aqueous emulsion 23 is maintained at a temperature of about 45° C. As shown in FIG. 4, the jet/fibriform element 2 is directed to and downwardly through a vertical cylinder 38. A spray of an aqueous solution of calcium chloride 24 (4–6% by weight) is produced by means of a spray means 39 and is directed onto the jet/fibriform element 2 during the passage thereof through the cylinder 38. The calcium chloride solution 24 is supplied from a reservoir thereof via a delivery tube 40 using pressurised air supplied from an air source 41 via an air line 42. A pressure gauge 43 is present in the air line 42. Droplets of excess calcium chloride solution 24 are removed via an exhaust duct 44 by use of suction, which suction is provided by fan means (not shown). Alternatively, as shown in FIG. 5, multiple jets/elements 2 travel down from the nozzle head 34 onto a rotating drum 45, the speed of rotation of the drum 45 being linked to the flow rate of emulsion 23 to the nozzle head 34.

Calcium chloride solution 24 is sprayed by means of spray means 39 onto the jets/elements 2 supported on the rotating drum 45. The calcium chloride solution 24 is supplied from a reservoir thereof via a delivery tube 40, using pressurised air supplied from an air source 41 via an air line 42. A pressure gauge 43 is present in the air line 42. Droplets of excess calcium chloride solution 24 on the drum 45 are collected in a tray (not shown positioned beneath the drum, and suction means (also not shown) is employed to remove excess droplets of the solution which are airborne.

The process as depicted in FIGS. 4 and 5, subsequent to the application of the calcium chloride solution 24, is substantially identical for either a single fibriform element 2 or a plurality of fibriform elements 2. That is to say, the element(s) 2 is dried using an air knife 46, 47 and/or a drying tunnel 48. Both the air knife 46, 47 and the drying tunnel 48 are arranged such that in operation heated air is passed about the fibriform element(s) 2. The resulting dried element(s) 2 is wound onto a spool(s) 49. When, as in FIG. 5, a plurality of elements 2 is manufactured, each is wound singularly on a spool 49. As a person skilled in the art would be aware, the direction of travel of the fibriform element(s) 2 during the manufacture thereof may be altered at any point in the process in order to relieve the fibriform element(s) 2 of excessive gravitational tensile forces and thus prevent breakage of the element(s) 2.

The process, as depicted in FIG. 5, allows for a plurality of fibriform elements 2 to be manufactured using minimal machinery.

In FIG. 6, reference numeral 50 designates generally a cigarette comprising a rod of tobacco 51 and a cigarette filter 52, the cigarette 50 further comprising a fibriform element 2 extending longitudinally and substantially coaxially of the tobacco rod 51. The fibriform element 2 comprises menthol encapsulated in an alginate matrix.

An advantage of using a fibriform element(s) comprising encapsulated menthol is that thereby an even distribution of menthol along the tobacco rod is readily attained; whereas the even distribution of capsules of encapsulated menthol along the rod can be difficult to achieve.

What is claimed is:

1. A process for the manufacture of a homogeneous fibriform element comprising a smoke-modifying agent, wherein a mixture comprising a solution of a polysaccharide and the smoke-modifying agent is fed through nozzle means, and a jet of said mixture issuing from said nozzle means is brought into contact with a solidification agent, wherein said solidification agent is a solution containing multivalent cations, an acidic solution, or a combination thereof, said solidification agent effecting solidification of said mixture.

2. A process according to claim 1, wherein said mixture is heated to provide an elevated temperature of said mixture and said mixture is fed through said nozzle means at the elevated temperature.

3. A process according to claim 1, wherein said jet of said mixture issuing from said nozzle means is fed into contact with a body of said solidification agent.

4. A process according to claim 3, wherein said body of said solution is a stream of said solidification agent.

5. A process according to claim 4, wherein said stream of said solidification agent flows in a direction substantially parallel to the direction in which said mixture issues from said nozzle means.

6. A process according to claim 4, wherein stream of said solidification agent is flowing within conduit means.

7. A process according to claim 6, wherein said nozzle means and said conduit means form an integral unit.

8. A process according to claim 6, wherein an upstream portion of said conduit means extends about said nozzle means so that immediately upon said jet issuing from said nozzle means said jet is surrounded by and is in contact with said solidification agent.

9. A process according to claim 6, wherein the residency time of said mixture in said conduit means is at least that required to ensure that the solidification process effected by the contact between said mixture and said solidification agent proceeds to a stage such that upon issuing from said conduit means the fibriform element is self-sustaining.

10. A process according to claim 1, wherein said solidification agent is sprayed onto said jet of said mixture issuing from said nozzle means.

11. A process according to claim 1, wherein said mixture takes the form of any one of the group consisting of a solution, a dispersion and an emulsion.

12. A process according to claim 1, wherein said polysaccharide is an acid polysaccharide in the form of an alkali metal salt.

13. A process according to claim 12, wherein said acid polysaccharide in the form of an alkali metal salt is sodium alginate.

14. A process according to claim 1, wherein said polysaccharide is any one of the group consisting of pectins, gellan gum, carrageenan, agar, gum arabic, xanthan gum and guar gum.

15. A process according to claim 1, wherein said multivalent cations are ions of the group consisting of calcium, strontium, barium, iron, silver, aluminum, manganese, vanadium, copper and zinc.

16. A process according to claim 1, wherein said solution containing multivalent cations is aqueous calcium chloride.

17. A process according claim 1, wherein said acidic solution is acetic acid.

* * * * *